US006979939B2

(12) United States Patent
Langlois et al.

(10) Patent No.: US 6,979,939 B2
(45) Date of Patent: Dec. 27, 2005

(54) COOLING DEVICE FOR AN ELECTRON TUBE

(75) Inventors: Michel Langlois, Thonon les Bains (FR); James McVea, Persippany, NJ (US); Jean-François Houdard, Thonon les Bains (FR)

(73) Assignee: Thales, Paris (FR)

( * ) Notice: Subject to any disclaimer, the term of this patent is extended or adjusted under 35 U.S.C. 154(b) by 306 days.

(21) Appl. No.: 10/403,525

(22) Filed: Apr. 1, 2003

(65) Prior Publication Data

US 2004/0011506 A1 Jan. 22, 2004

(30) Foreign Application Priority Data

Apr. 5, 2002 (FR) ..... 02 04261

(51) Int. Cl.[7] ..... H01J 23/033; F28D 15/00

(52) U.S. Cl. ..... 313/22; 313/35; 165/80.4; 165/104.14; 165/104.33

(58) Field of Search ..... 165/80.4, 104.14, 165/104.33; 313/17, 22, 35, 36, 39, 44

(56) References Cited

U.S. PATENT DOCUMENTS 2,146,541 A * 2/1939 Hansell ..... 315/50
2,342,412 A * 2/1944 Little et al. ..... 313/12
3,255,813 A * 6/1966 Besson et al. ..... 165/104.33
3,414,753 A * 12/1968 Hruda ..... 165/80.4
3,970,891 A * 7/1976 Heynisch et al. ..... 315/3.5
6,601,641 B1 * 8/2003 Stefanik et al. ..... 165/80.4

FOREIGN PATENT DOCUMENTS

| | | |
|---|---|---|
| GB | 558975 | 1/1944 |
| GB | 706209 | 3/1954 |
| GB | 770580 | 3/1957 |
| GB | 109955 | 12/1967 |

* cited by examiner

*Primary Examiner*—Mariceli Santiago
(74) *Attorney, Agent, or Firm*—Lowe Hauptman & Berner, LLP

(57) ABSTRACT

The present invention relates to a cooling device for an electron tube designated to amplify a high frequency signal. The invention is particularly suitable for cooling electron tubes that amplify radio frequency signals used for television or radio. The electron tube installed on a portal frame designed to hold the frame. The device includes a first hydraulic circuit inside which a first fluid circulates to cool at least part of the tube. The device also includes fluid exchanger to transfer heat transported by the first fluid to a second hydraulic circuit. The exchanger is also located on the portal frame.

20 Claims, 3 Drawing Sheets

COOLING DEVICE FOR AN ELECTRON TUBE

This document claims priority to FR 0204261, filed Apr. 5, 2002, the entire content of which is hereby incorporated by reference.

FIELD OF THE INVENTION

The invention relates to a cooling device for an electron tube designed to amplify a high frequency signal.

The invention is particularly suitable for cooling electron tubes that amplify radio frequency signals used for television or for radio.

The invention will be described with regard to an Inductive Output Tube well known in the English literature as an IOT. Obviously, it may be used for any other type of electron tube, such as a traveling wave tube or a klystron.

BACKGROUND OF THE INVENTION

Inductive output tubes are used particularly as the final amplification stage for a radio frequency signal, the output from the tube being connected to a transmission antenna. These tubes transfer high electrical powers and their efficiency is typically of the order of 50%. Due to this efficiency, there is a large amount of emitted heat that has to be dissipated.

Heat is emitted particularly in a tube collector. The collector forms one of the ends of the tube and receives the electrons emitted by an electron gun at the other end of the tube. Electrons interact with cavities, on their path between the electron gun and the collector. This interaction amplifies a radio frequency signal. When the electrons bombard the collector, they still have a high amount of energy that increases the temperature of the collector. The collector can be cooled using a hydraulic circuit by circulating a heat transporting fluid, for example water, inside the collector. For example, the hydraulic circuit may include a fluid-air exchanger located outside a building in which the tube is located. The heat transported by the heat transporting fluid is then carried outside the building into the ambient air.

To make sure that operation is possible under all circumstances and particularly when the ambient temperature is below 0° Celsius, an anti-freeze product, for example containing glycol, is added to the water in the heat transporting fluid.

Some collectors used particularly in inductive output tubes are said to be vacuum collectors. More precisely, this type of collector comprises several electrodes that are at different potentials up to several kilovolts. This type of collector can increase the efficiency of the electron tube in which it is installed. Nevertheless, the collector has to be cooled. If the cooling means described above are used, it is necessary to use a particular anti-freeze product with a high resistivity to avoid creating a medium along which an electric current can pass between the different electrodes of the collector. This particular anti-freeze product is much more expensive than more conventional products, for example like those used in the cooling circuit of an automobile vehicle.

SUMMARY OF THE INVENTION

The purpose of the invention is to overcome this problem, and consequently its purpose is a cooling device for an electron tube designed to amplify a high frequency signal, the electron tube being installed on a portal frame on which the device will be fitted, the device comprising a first hydraulic circuit inside which a first fluid circulates to cool at least part of the tube, a fluid-fluid exchanger transferring heat transported by the first fluid to a second hydraulic circuit, the exchanger being located on the portal frame.

With the invention, it is possible in particular to replace a collector tube fully connected to the electrical ground by a vacuum collector tube without modifying the existing cooling circuit in the building which then becomes the second hydraulic circuit according to the invention. This replacement can significantly increase the amplification efficiency of the radio frequency signal achieved by the tube without modifying the existing infrastructure in the building. All that is necessary for this purpose is to replace a collector tube connected to the ground by a vacuum collector tube, to which the first hydraulic circuit is added. The hydraulic circuit existing in the building is then connected to the fluid-fluid exchanger in the invention without modifying the composition of the heat transporting fluid. Since the existing hydraulic circuit in the building has become the second hydraulic circuit in the invention, no electrical power is applied to it and a conventional anti-freeze product can be used in it without the risk of an electric current being present.

BRIEF DESCRIPTION OF DRAWINGS

The invention will be better understood and other advantages will become clear after reading the following detailed description of an embodiment given as an example, illustrated by the appended drawing in which.

DESCRIPTION OF PREFERED EMBODIMENT

Figure 1:
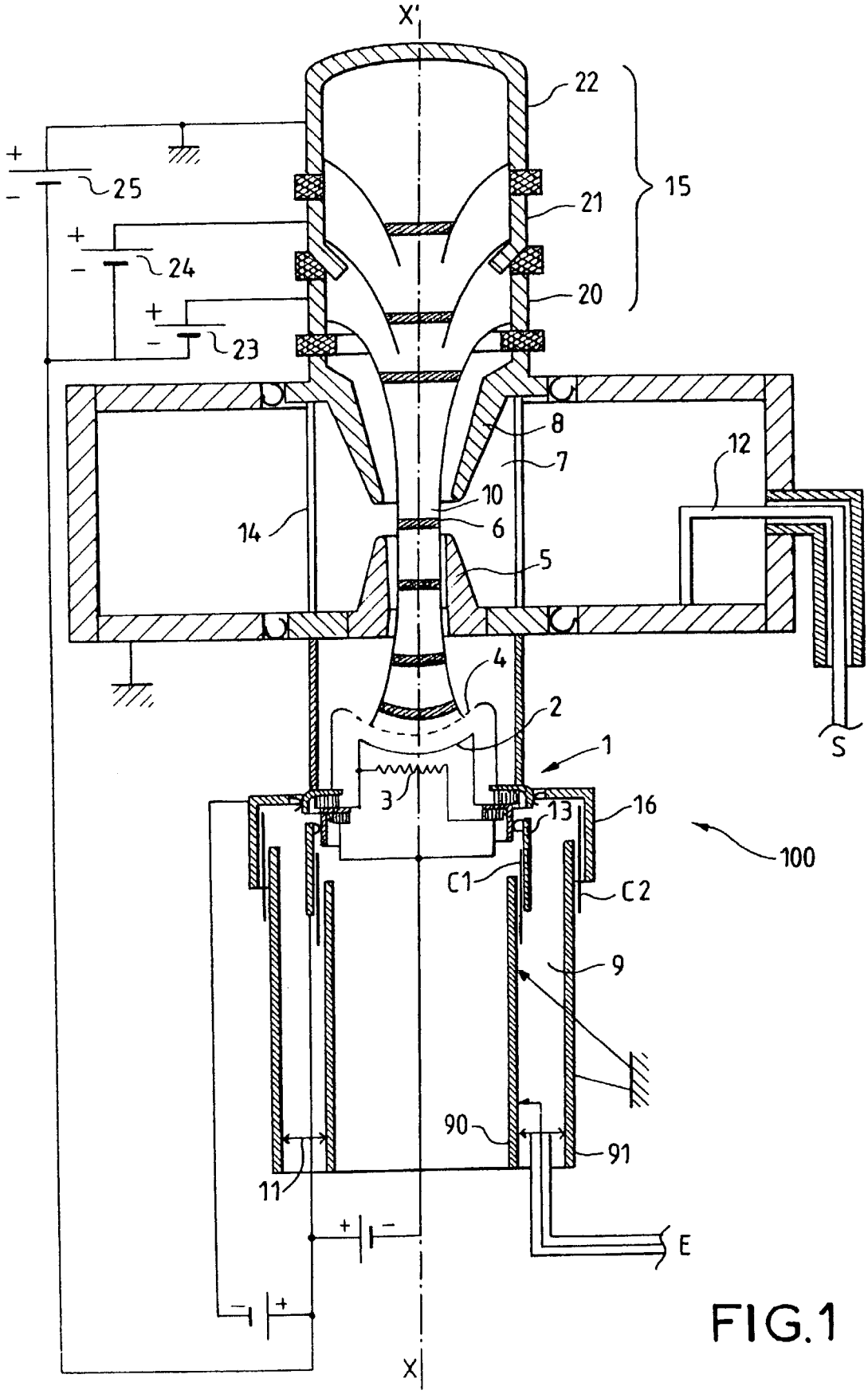
FIG. 1 shows an inductive output tube.

The electron tube 100 shown in FIG. 1 has an axial electron beam and in principle at the input uses amplitude modulation as in conventional tubes with a grid, and at the output uses the axial structure of speed modulation tubes as in klystrons.

More precisely, in sequence, the tube comprises an electron gun 1 built around an axis of revolution XX' and, along the axis, an anode 5 forming a first sliding tube that opens up into an interaction space 6 of a resonant output cavity 7, the interaction space 6 being delimited by a second sliding tube called the interaction nozzle 8 that is facing the first tube, and then a collector 15. The two nozzles of the sliding tubes are facing each other. The gun 1 comprises a cathode 2, its heating filament 3 and a grid 4. The cathode 2/grid 4 space forms the tube input circuit, and the input signal E is usually carried to the input circuit of the tube through a coaxial resonant input cavity 9 coupled to the cathode/grid space. In the described example, the input signal E to be amplified is input into the cavity 9 by inductive coupling means in a loop. This input signal E is provided by tube means external to the tube usually including a pre-amplifier (not shown in FIG. 1).

Grid 4 and cathode 2 are brought to high negative DC voltages and electrons emitted by the cathode emerge from the grid 4 in the form of a beam 10 in packets that are already modulated in density by the input signal E. The beam 10 is longitudinal along axis XX'. The electrons of the beam 10 attracted and focused by the anode 5 penetrate into the output cavity 7 and pass through the interaction space 6 in which they are coupled to the electromagnetic field of the resonant cavity 7. An output signal S with a much higher power than the input signal E can be extracted from this output cavity 7. The electrons have released much of their energy, and are then collected by the walls of the collector 15. The anode 5 is usually connected to the ground.

When the electron tube is designed to operate with a modulated output power as in television transmitters, the input signal E is the carrier of the modulation. The coaxial input cavity 9 formed with two coaxial conducting cylinders 90, 91, is usually provided with a device 11 for adjusting its resonant frequency, for example a piston with an adjustable position. This coaxial input cavity 9 is connected to the electrical ground, for safety reasons and to decouple the preamplifier from the high voltage. A decoupling capacitor C1 provides electrical isolation for DC currents between the internal cylinder 90 and the cathode 2, and another decoupling capacitor C2 provides electrical isolation between the external cylinder 91 and the modulation grid 4. These capacitors C1, C2 may be made of insulating sheets clamped between a cylinder 90, 91 respectively of the cavity and the corresponding cylindrical part 13, 16 connected to the corresponding electrode 2, 4.

In this application as a transmitter in the UHF band, high voltages are of the order of several tens of kilovolts and the cathode is always less negative than the grid.

The power of the output signal S is amplified compared with the input signal E and the signal is extracted from the output cavity 7, for example by either capacitive or inductive coupling. Inductive coupling is shown in the figure in the form of a conductor 12 that defines a loop in the output cavity 7. It is transmitted to a user device such as an antenna (not shown).

The inside of the tube is conventionally subjected to a vacuum. Leak tightness is achieved at the output cavity 7 by using a dielectric sleeve 14 that allows the energy to be extracted to pass through. Part of the output cavity 7 is external. It is delimited by the walls that are in contact with the collars contiguous with the sleeve on the side on which it is not subject to the vacuum.

When the collector 15 is fully connected to the ground, the efficiency of an electron tube is of the order of 50%. More precisely, the energy contained in the output signal S is of the order of half the energy received by the electron tube 100, essentially through the contained voltage sources powering it. Most of the energy dissipated by the electron tube is dissipated at the collector 15 inside which ducts are provided, through which a fluid circulates that also cools the interaction nozzle 8. A smaller part,of the energy is dissipated at the interaction nozzle 8.

Advantageously, the collector 15 comprises several electrodes at different potentials. In FIG. 1, three electrodes 20, 21 and 22 are shown and are separated by insulators 30 and 31. Obviously, the number of electrodes is only given as an example. This collector structure 15 comprising several electrodes is called a vacuum collector.

These different electrodes are provided to slow the electrons before they strike the walls of the electrodes. Thus the heat dissipated in the collector 15 is reduced and the efficiency of the electron tube 100 increases.

FIG. 1 shows a particular layout of a vacuum collector, given as an example. A DC voltage source 23 is connected between the first electrode 20 and the cathode 12. A DC voltage source 24 is connected between the second electrode 21 and the cathode 12. A final voltage source 25 is connected between the third electrode 22 and the cathode 16. The three electrodes 20, 21 and 22 belonging to the collector 15 are laid out such that the electrode 20 to which the highest voltage is applied with respect to cathode 12 is closest to the cathode 12, and the electrode 22 to which the lowest voltage with respect to the cathode 12 is applied is furthest from the cathode 12.

Despite the particular structure of the vacuum collector 15, the kinetic energy of the electrons that bombard the three electrodes 20, 21 and 22 is still high and generates heat that has to be evacuated.

Figure 2:
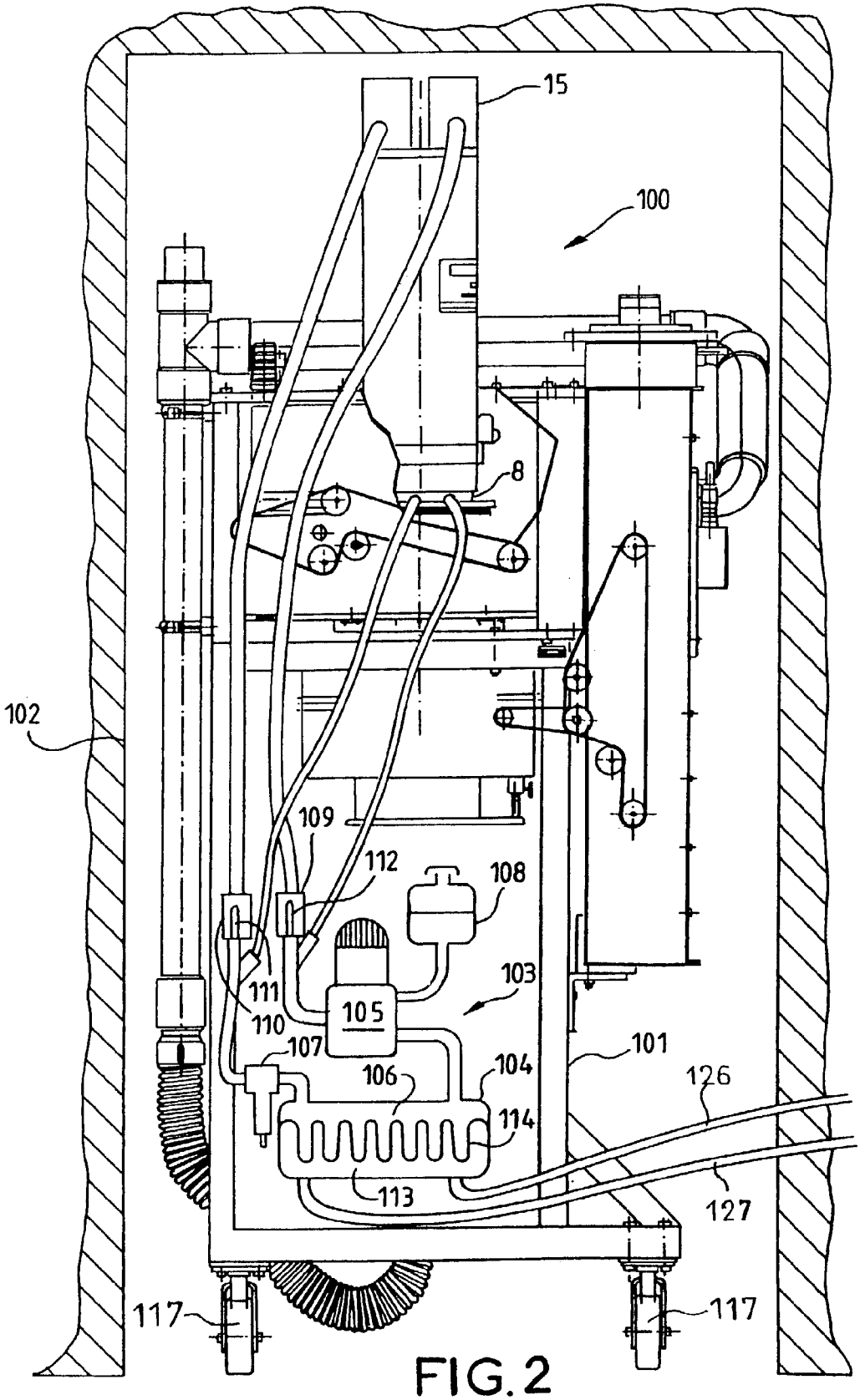
FIG. 2 shows the tube in FIG. 1 and its cooling device.

In FIG. 2, the electron tube 100 is advantageously located in a cabinet 102. The walls of the cabinet 102 are used particularly as a screen against any electromagnetic radiation emitted by the tube 100 or that could be received by it and that could modify its operation or the operation of electronic equipment outside the cabinet 102. For example, this equipment includes devices for forming the input signal E.

FIG. 2 also shows a device for cooling the electron tube 100. The cooling device comprises a first hydraulic circuit 103 in which a first fluid circulates to cool at least part of the electron tube 100. In particular, it is important to cool the collector 15 and to a lesser extent, the interaction nozzle 8. The cooling device comprises a fluid-fluid exchanger 104 inside the cabinet 102 to transfer heat transported by the first fluid to a second fluid circulating in a second hydraulic circuit.

The electron tube 100 is placed on a portal frame 101 located in the cabinet 102. The exchanger 104 is then installed on the portal frame. Advantageously, the first hydraulic circuit 103 is laid out on the portal frame (101).

The portal frame consists of a carriage that moves with respect to cabinet 102. Mobility is ensure, for example, by wheels 117 located on the base of portal frame 101. Portal frame 101 can thus be removed from cabinet 102 even during operation. It is therefore possible to check the correct operation of the electron tube 100 outside the cabinet 102. The operating check consists for example in detecting any leaks in the first hydraulic circuit 103, or checking or adjusting the electrical operation of the electron tube 100 by connecting electronic measuring instruments to it. This allows the passband of the electron tube 100 to be adjusted from outside the cabinet 102. After making the checks and adjustments, the electron tube 100 can be put back in position in the cabinet 102 without interrupting the electron tube 100 cooling process.

The first hydraulic circuit 103 comprises a circulation pump 105 allowing the first fluid to circulate in a first compartment 106 of the exchanger 104 and in the part(s) of the electron tube 100 to be cooled. The first hydraulic circuit 103 also comprises first means 107 to maintain the resistivity of the fluid circulating in the first hydraulic circuit 103 above a limiting value.

Advantageously, the means 107 may comprise a resin creating an ion exchange. More precisely, the transfer of hydraulic fluid on the resin enables replacement of ions that tend to reduce the resistivity of the hydraulic fluid by other ions that do not reduce the resistivity of the fluid. For example, mineral salts are replaced by hydroxyl or hydronium ions. For example, the resin comprises organic compounds obtained by polymerization of a monomer and on which functional groups are grafted that will define ions that can be picked up during the ion exchange phase.

In the embodiment described herein, the first hydraulic circuit 103 comprises the circulation pump 105, the first compartment 106 of the exchanger 104, a filter 107 comprising first means to maintain the resistivity of the fluid circulating in the first hydraulic circuit 103 above the limiting value and the part(s) of the electron tube 100 to be cooled, all in series. The first hydraulic circuit may also comprise an expansion vessel 106, for example connected to the circulation pump 105, allowing expansion of the first fluid. As an alternative to the expansion vessel and to facilitate filling and emptying of the first hydraulic circuit, a tank could be provided in which the fluid output from the parts of the tube 100 to be cooled is poured, and from which the circulation pump 105 draws fluid. The tank is kept at approximately atmospheric pressure. It may consist of a receptacle closed by a double valve allowing external air to enter and leave the tank.

Advantageously, the first means 107 for maintaining the resistivity of the fluid comprise second means to prevent operation of the first means when the resistivity of the fluid is above the limiting value. More precisely, the resistivity of the fluid circulating in the first hydraulic circuit can be measured, and the first means 107 can be prevented from operating to keep the resistivity of the fluid circulating in the first hydraulic circuit 103 above a limiting value only when necessary, in other words when the resistivity drops below the limiting value.

On the other hand, it is also possible to make sure that part of the fluid circulates in the first means 107 at all times. More precisely, only part of the fluid at the output from compartment 106 circulates in the filter 107, and the rest of the fluid does not pass through it. The proportion of fluid passing through the filter is defined such that the resistivity of the fluid is kept above the limiting value.

Advantageously, the fluid contained in the first hydraulic circuit contains an anti-freeze product for which the resistivity can be kept above a limiting value.

Advantageously, the first hydraulic circuit comprises at least one sacrificial electrode. More precisely, at least one part is put into the hydraulic circuit that will deteriorate in priority before the rest of the hydraulic circuit. This part may be made from a material with an electrochemical potential such that it will oxidize in priority or it may be made with a particular shape that will result in the same effect. This electrode will be changed periodically. For example, two connectors 109 and 110 could be provided to connect the collector 15 to the rest of the first hydraulic circuit. Each of these connectors 109 and 110 could comprise a sacrificial electrode, 111 and 112 respectively.

In the first hydraulic circuit as shown in FIG. 2, the interaction nozzle 8 is connected in parallel with the collector 15. The interaction nozzle 8 increases in temperature less than the collector 15, consequently it is only necessary to circulate a small proportion of the total flow of the fluid circulating in the first hydraulic circuit. However, the collector 15 and the interaction nozzle 8 could also be connected in series.

The exchanger 104 comprises a second compartment 113 in which a second fluid circulates in a second hydraulic circuit. The heat transfer between the first and second hydraulic circuit takes place through a plate 114 separating the two compartments 106 and 113 of the exchanger 104.

Figure 3:
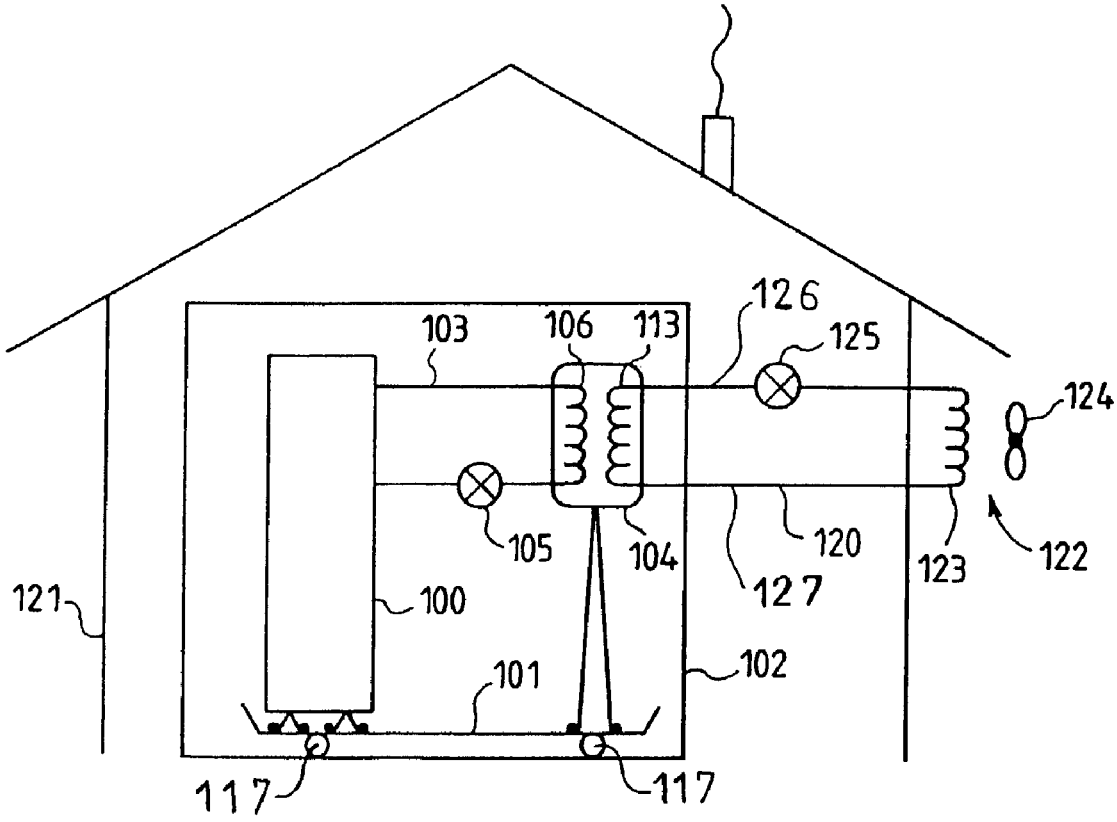
FIG. 3 diagrammatically shows the electron tube and two hydraulic circuits for cooling it.

FIG. 3 will help understand the structure of the second hydraulic circuit 120. In this figure, the first hydraulic circuit has been simplified and only includes the tube 100, the circulation pump 105 and the first compartment 106 of the exchanger 104. The tube 100, the pump 105 and the exchanger 104 are placed on a portal frame 101 and are contained in the cabinet 102. The cabinet 102 itself is contained in a building 121.

The second hydraulic circuit 120 comprises the second compartment 113 of the exchanger 104, a circulation pump 125 and a fluid-air exchanger 122 located outside the building 121 in order to evacuate heat transported by the fluid contained in the second hydraulic circuit 120 to ambient air outside the building 122. For example, the exchanger 122 may comprise a compartment 123 in which fluid in the second hydraulic circuit 120 circulates, and a fan 124 forcing convection of ambient air to cool the compartment 123.

In the second hydraulic circuit 120, hoses 126 and 127 can be installed to connect the exchanger 104 to the second compartment 113. As demonstrated above, this will allow the electron tube 100 to move more easily in the cabinet 102, without interrupting the electron tube 100 cooling process.

What is claimed is:

1. A cooling device for an electron tube designed to amplify a high frequency signal, the electron tube being installed on a portal frame on which the device will be fitted, the device comprising a first hydraulic circuit inside which a first fluid circulates to cool at least part of the tube, a fluid-fluid exchanger transferring heat transported by the first fluid to a second hydraulic circuit, the exchanger being located on the portal frame, and a second hydraulic circuit having a second exchanger in order to evacuate heat transported by the fluid contained in said second hydraulic circuit.

2. The device according to claim 1, wherein the first hydraulic circuit is installed on the portal frame.

3. The device according to claim 1, wherein the part of the tube comprises a vacuum collector.

4. The device according to claim 1, wherein the second hydraulic circuit evacuates heat collected in the exchanger outside a building inside which the portal frame is located.

5. The device according to claim 4, wherein the second hydraulic circuit comprises a fluid-air exchanger located outside the building exchanger in which the second fluid transfers heat that it transports to ambient air outside the building.

6. The device according to claim 1, wherein it comprises first means of maintaining the resistivity of the fluid circulating in the first hydraulic circuit above a limiting value.

7. The device according to claim 6, wherein the first means of maintaining the resistivity of the fluid comprise second means to prevent operation of the first means when the resistivity of the fluid is above the limiting value.

8. The device according to claim 6, wherein part of the fluid circulates in the first means at all times.

9. The device according to claim 1, wherein the first fluid contains an anti-freeze product with a resistivity that is kept above a limiting value.

10. The device according to claim 1, wherein the first hydraulic circuit comprises at least one sacrificial electrode.

11. The device according to claim 1, wherein the portal frame includes devices to displace the electron tube without interrupting the electron tube cooling process.

12. The device according to claim 11, wherein the devices used to displace the electron tube are fitted with wheels.

13. The device according to claim 1, wherein said second hydraulic circuit operates as a closed loop.

14. A cooling device for an electron tube designed to amplify a high frequency signal, the electron tube being installed on a portal frame on which the device will be fitted, the device comprising a first hydraulic circuit inside which a first fluid circulates to cool at least part of the tube, a fluid-fluid exchanger transferring heat transported by the first fluid to a second hydraulic circuit, the exchanger being located on the portal frame, wherein said portal frame includes a movable carriage having wheels.

15. The device according to claim 14, wherein the first hydraulic circuit is installed on the portal frame.

16. The device according to claim 14, wherein the part of the tube comprises a vacuum collector.

17. The device according to claim 14, wherein the second hydraulic circuit evacuates heat collected in the exchanger outside a building inside which the portal frame is located.

18. The device according to claim 17, wherein the second hydraulic circuit comprises a fluid-air exchanger located outside the building exchanger in which the second fluid transfers heat that it transports to ambient air outside the building.

19. The device according to claim 14, wherein it comprises first means of maintaining the resistivity of the fluid circulating in the first hydraulic circuit above a limiting value.

20. The device according to claim 19, wherein the first means of maintaining the resistivity of the fluid comprise second means to prevent operation of the first means when the resistivity of the fluid is above the limiting value.

* * * * *